US006533267B1

(12) United States Patent
Muessig et al.

(10) Patent No.: US 6,533,267 B1
(45) Date of Patent: Mar. 18, 2003

(54) METHOD AND APPARATUS FOR THE ALIGNMENT OF TEXTILE MATERIAL SECTIONS

(75) Inventors: Karl Muessig, Bad Koenigshofen (DE); Roland Behr, Grossbardorf (DE)

(73) Assignee: Texpa Maschinenbau GmbH & Co. KG (DE)

( * ) Notice: Subject to any disclaimer, the term of this patent is extended or adjusted under 35 U.S.C. 154(b) by 0 days.

(21) Appl. No.: 09/560,083

(22) Filed: Apr. 27, 2000

(30) Foreign Application Priority Data

Apr. 30, 1999 (DE) ..... 199 19 875
Apr. 18, 2000 (DE) ..... 100 19 363

(51) Int. Cl.[7] ..... B65H 7/02; D05B 27/00; B31F 1/00

(52) U.S. Cl. ..... 271/228; 38/143; 112/306; 112/475.07; 271/85; 493/417

(58) Field of Search ..... 271/228, 227, 271/85; 493/416, 417, 437, 451, 937; 38/143; 26/51.4, 51.5, 75, 79, 93; 112/470.03, 470.07, 475.03, 475.07, 304, 306

(56) References Cited

U.S. PATENT DOCUMENTS 4,181,085 A * 1/1980 Conner, Jr. ..... 112/470.07
4,371,159 A * 2/1983 Doyen et al. ..... 271/228
4,501,529 A * 2/1985 Wiebesiek ..... 38/143
4,754,717 A * 7/1988 Henze et al. ..... 112/306
4,774,505 A * 9/1988 Ueda et al. ..... 38/143
5,238,234 A * 8/1993 Kerber et al. ..... 271/228
5,333,402 A * 8/1994 Weir ..... 271/85
5,430,915 A * 7/1995 Ueda et al. ..... 38/143
5,480,133 A * 1/1996 Motev et al. ..... 271/268
5,514,233 A * 5/1996 Miyamoto ..... 271/228

FOREIGN PATENT DOCUMENTS

DE 299 08 280 U1 9/1999

* cited by examiner

*Primary Examiner*—Michael R. Mansen
(74) *Attorney, Agent, or Firm*—McGlew and Tuttle, P.C.

(57) ABSTRACT

A method of aligning a portion of textile fabric, whereby at least two movable gripping elements of a display device are brought alongside one another into contact with and fastened to a front edge of the portion of fabric and the gripping elements are moved substantially parallel to the surface of a display surface until the portion of fabric is laid out with one side flat on the display surface. In this case, the feed rate of the independently controllable gripping elements (2*a*, 2*b*) is so selected that the alignment of the portion of fabric (4) is variable by a feed difference (d, v) between the gripping elements (2*a*, 2*b*).

19 Claims, 3 Drawing Sheets

METHOD AND APPARATUS FOR THE ALIGNMENT OF TEXTILE MATERIAL SECTIONS

FIELD OF THE INVENTION

The invention relates to a method and apparatus for aligning a portion of textile fabric, and in particular to a method and apparatus with gripping elements moving the fabric across a display surface. At least two independently controllable and movable gripping elements of a display device are brought alongside one another, into contact with, and fastened to, a front edge of a portion of a fabric. The gripping elements are moved substantially parallel to the display surface of the display device until the portion of fabric is laid out with one side flat on the display surface.

BACKGROUND OF THE INVENTION

From DE 299 08 280 an apparatus for inspecting portions of textile fabric, in particular of towelling, is known. Said apparatus allows initially one side of the portion of fabric to be laid out flat with the aid of movable gripping elements so that the upper side may be inspected. The gripping elements are then moved in the opposite direction, with the result that the portion of fabric is turned over to allow inspection of the second side.

Many production sequences require the portion of fabric to have a specific alignment so that it may, e.g. in a downstream folding installation, be folded in the correct position. Problems with the alignment of the portions of fabric arise particularly when, because of specific production conditions or because of properties of the fabric, the edges of the portion of fabric do not extend at right angles to one another. Thus, for example, installations for manufacturing hand towels are known, in which the edges of the hand towels after sewing extend in the manner of a parallelogram relative to one another. This means that the front edge and the back edge, on the one hand, and the two side edges, on the other hand, extend in each case parallel to one another but the side edges are not at right angles to the front or back edge.

A drawback of the known apparatus is that an alignment of the portions of fabric is not possible.

SUMMARY AND OBJECTS OF THE INVENTION

The object of the present invention is to propose an apparatus for turning a portion of textile fabric, which avoids said drawback.

Said object is achieved according to the invention by a method and an apparatus. The method provides a display surface with an alignment set point. First and second gripping elements are provided which are independently movable across the display surface. A first edge of the fabric is connected to the gripping elements. The gripping elements with the fabric are then moved across the display surface. An offset distance from a second edge of the fabric to the alignment set point is measured and a rate of moving of the gripping elements is adjusted to minimize the offset distance. A control unit is provided which controls the movement of the gripping elements to minimize the offset distance.

According to the invention, the gripping elements are controllable independently of one another and may therefore be positioned independently of one another. This may be realized, for example, by mounting each gripping element on a separate slide, wherein the slides are each driven independently of one another by individually controllable motors. The effect according to the invention is based on the fact that the alignment of the portion of fabric is clearly determined by the shape of an edge of the portion of fabric so long as the portion of fabric is lying flat on the display surface. By means of a feed difference between the gripping elements fastened to the front edge it is therefore possible to vary the alignment of the front edge and hence the alignment of the entire portion of fabric. In said case, however, it should be noted that for alignment of the portion of fabric at the front edge only pulling may be used because pushing forces are not transmissible in a web of fabric. The feed difference between the gripping elements is therefore achieved according to the invention in that the gripping elements are at least temporarily driven at different feed rates. As a result of the rate difference the feed difference is continuously increased, with the result that fold formation in the fabric may be avoided.

The method according to the invention may be implemented particularly easily and the apparatus according to the invention may be of a particularly simple design when, for turning the portion of fabric, two gripping elements are provided, which may be fixed in the corners of the portion of fabric.

It is advantageous when the actual alignment of the portion of fabric, as the latter is laid out on the display surface, may be measured by a position sensor. For said purpose it is possible to use, for example, a distance sensor which is disposed on the display surface in the region of one of the two side edges. From a variation of the distance between the sensor and the side edge it may be inferred that the side edge is not being drawn in parallel to the conveying direction. In said case, for example, the feed rate of one of the gripping elements may be increased by a specific amount until the distance once more corresponds to a specific setpoint distance.

With the method according to the invention, the alignment of the portion of fabric may be adjusted also in the manner of a control loop.

When a portion of fabric is turned over, it is desirable for the portion of fabric to be laid out on the display surface in the correct position, i.e. in accordance with the setpoint alignment, both before and after turning. Where this is required, it is naturally possible to align the portion of fabric in accordance with the proposed method before and after turning in each case with the aid of the position sensor. However, as each aligning operation with the aid of the position sensor takes a specific amount of time, this increases the throughput times and hence the cost of production. With a particularly advantageous process sequence, however, it is possible to eliminate aligning of the portion of fabric after turning.

In said case, first the feed difference between the gripping elements is acquired after the portion of fabric has been laid out in the correct position prior to turning, i.e. with the first side situated underneath. The special implementation of the method for eliminating the aligning operation after turning is based on the discovery that the necessary feed difference for laying out the portion of fabric in the correct position after turning, in terms of its amount, corresponds to the feed difference for aligning the portion of fabric prior to turning. Thus, in order to lay out the portion of fabric in the correct position after turning without remeasuring the alignment, all that is required is to include the necessary feed difference, which was established during the first laying-out operation, in the feed values for moving in the opposite direction to turn the portion of fabric. For complete turning of the portion of fabric, the gripping element with the lowest feed value during the first laying-out operation, in order to turn the portion of fabric, has to be moved in the opposite direction by a feed value which is at least greater than the length of the portion of fabric. The gripping element with the greatest feed value during the first laying-out operation, on the other hand, for turning the portion of fabric is moved in the opposite direction by a feed value, which arises from the sum of the feed value of the first gripping element during the turning operation and twice the acquired feed difference.

When more than two gripping elements are involved in manipulating the portion of fabric, the feed values of the gripping elements between the two outermost gripping elements arise in accordance with the distance between the gripping elements as intermediate values.

Since in the course of turning the portion of fabric a top layer of the fabric is drawn across a bottom layer, if the movement of the gripping elements is not synchronized this may lead to undesirable fold formation in the portion of fabric. It is therefore particularly advantageous when the second gripping element during turning in a first phase is initially moved in the opposite direction by a feed value, which is twice the stored feed difference, while at the same time the first gripping element is initially stationary. Thus, in the first turning phase the double feed difference required between the gripping elements for positionally correct turning is initially compensated. Then, for complete turning of the portion of fabric, in a second phase both gripping elements are synchronously moved in the opposite direction by a feed value, which is at least greater than the length of the portion of fabric.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1A:
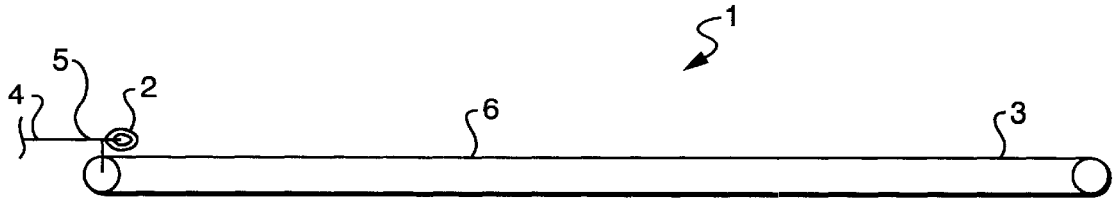
FIGS. 1A, 1B, 1C and 1D are side views showing four phases of turning a portion of fabric with a turning apparatus in side view.
Figure 1B:
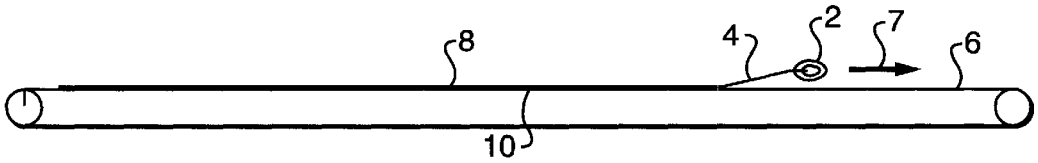
Figure 1C:
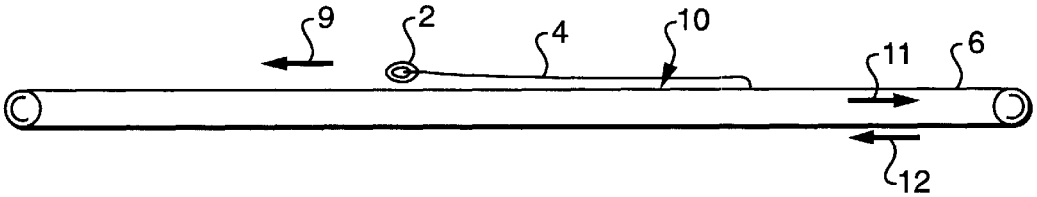
Figure 1D:
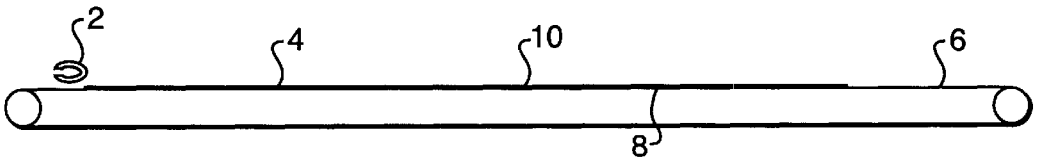

FIG. 1 shows a turning apparatus 1 comprising a gripping device 2 formed by two gripping elements 2*a* and 2*b* as well as a display surface 6 formed by a conveyor belt 3. The gripping device 2 may be brought into contact with and fastened to a front edge 5 of a portion of fabric 4 so that, by feeding the gripping device 2 in the direction of the direction arrow 7, the portion of fabric 4 may be laid out on the display surface 6.

When the gripping device 2 has been moved up to the right end of the conveyor belt 3, the portion of fabric 4 lies flat on the display surface so that the one side 8 of the portion of fabric is directed upwards and the other side 10 of the portion of fabric 4 rests on the conveyor belt 3.

To turn the portion of fabric 4, the gripping device 2 is moved in the opposite direction, i.e. in the direction of the direction arrow 9. At the same time, the conveyor belt 3 may be driven in accordance with the direction arrows 11 and 12 in order to speed up the turning operation. As soon as the gripping device 2 has arrived at the left end of the conveyor belt 3, the turned-over portion of fabric 4 lies flat on the display surface 6 so that the side 10 of the portion of fabric 4 is directed upwards and the side 8 lies adjacent to the conveyor belt 3.

Figure 2:
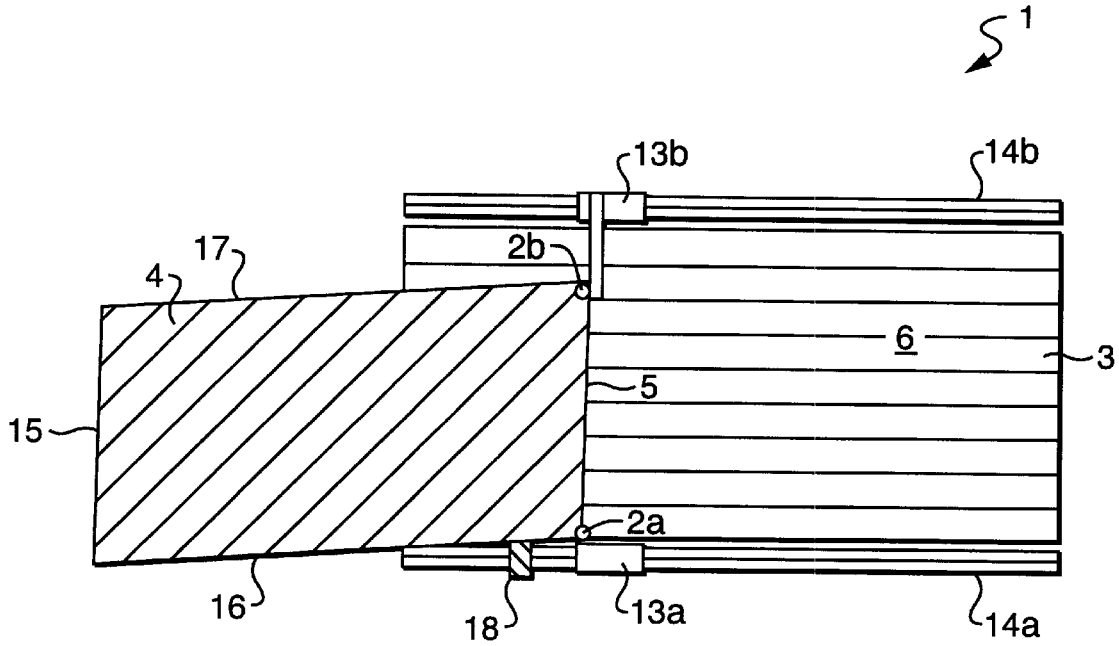
FIG. 2 a first phase of a turning operation in plan view.

FIG. 2 shows, in plan view, the turning apparatus 1 with the gripping elements 2*a* and 2*b* and the conveyor belt 3 forming the display surface 6. The gripping elements 2*a* and 2*b* fix the portion of fabric 4 in the corners at the front edge 5. Said gripping elements 2*a* and 2*b* are mounted in each case on a slide 13*a* and 13*b*, which may be moved along sliding rails 14*a* and 14*b* by means of drive motors (not shown). The drive motors of the slides 13*a* and 13*b* may be controlled independently of one another by a control unit (not shown) so that the gripping elements 2*a* and 2*b* are positionable independently of one another along the sliding rails 14*a* and 14*b*.

The portion of fabric 4 illustrated in FIG. 2 to FIG. 5 is in the shape of a parallelogram. In other words, the front edge 5 and a back edge 15, on the one hand, and the two side edges 16 and 17 extend in each case parallel to one another but there is not a right angle between the side edges 16 and 17 and the front edge 5 and/or back edge 15. When the portion of fabric 4 is laid out on the display surface 6 through synchronous feed of the gripping elements 2*a* and 2*b*, because of the parallelogram-shaped structure of the portion of fabric 4 the side edges 16 and 17 are not drawn in parallel relative to the alignment of the conveyor belt 3 by the gripping elements 2*a* and 2*b*. As the alignment of the conveyor belt 3 in the present case corresponds to the setpoint alignment, said mismatch between the alignment of the portion of fabric 4 in relation to the side edges 16 and 17 and the alignment of the conveyor belt 3 is undesirable.

To enable acquisition of the actual alignment of the portion of fabric 4, the turning apparatus 1 is provided with a position sensor 18 designed in the manner of a distance sensor, with the aid of which the alignment of the side edge 17 may be determined by comparing the actual distance value between sensor 18 and side edge 17 in each case with an initial value. As soon as the distance value alters and thereby indicates that the side edge is not being drawn in parallel to the alignment of the conveyor belt 3, the control unit accordingly increases or reduces the feed rate of one of the gripping elements 2*a* or 2*b* by a specific value until the actual distance once more corresponds to the initial value.

Figure 3:
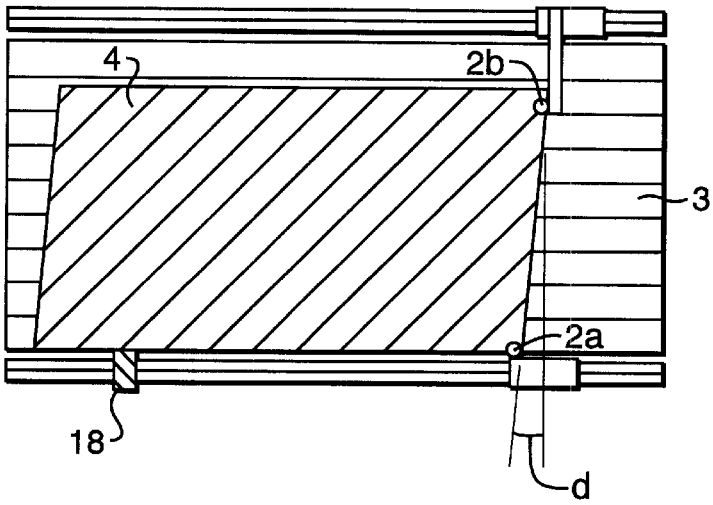
FIG. 3 a second phase of a turning operation in plan view.

FIG. 3 shows the alignment of the portion of fabric 4 in accordance with the desired setpoint alignment after reaching the turning point. Because of the rate difference, the gripping elements 2*a* and 2*b* occupy different positions along the sliding rails 14*a* and 14*b*, thereby producing between them precisely a feed difference d which compensates the angular deviation between front edge 5 and the side edges 16 and 17. The feed difference d is in said case just great enough to achieve an alignment of the portion of fabric 4 whereby the side edge 17 extends parallel to the alignment of the conveyor belt 3.

Figure 4:
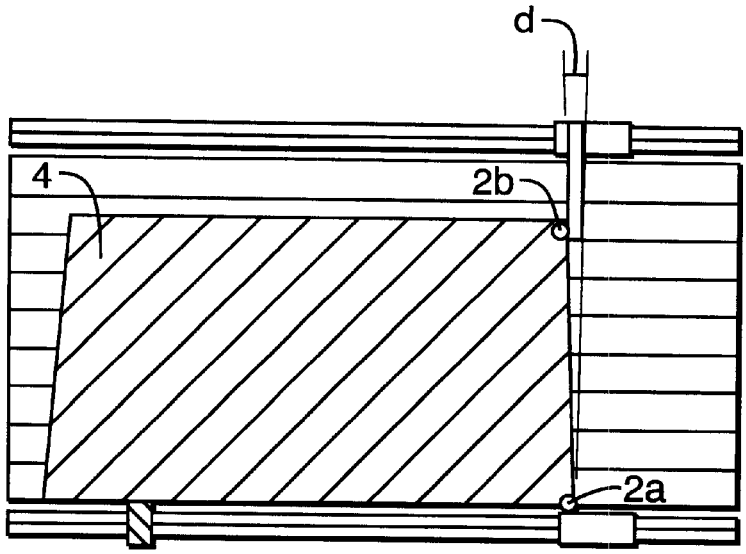
FIG. 4 a third phase of a turning operation in plan view.

FIG. 4 shows a first phase of the turning operation for turning the portion of fabric 4. The aim of the turning operation is for the portion of fabric 4 to be laid out in the correct position also after the turning operation, wherein however a re-alignment of the portion of fabric 4 with the aid of the position sensor 18 is to be avoided. This is achieved in that the gripping element 2*b* initially in the first phase is moved in the opposite direction by a feed value corresponding to twice the feed difference d. In said first phase of the turning operation, the gripping element 2*a* is stationary.

Figure 5:
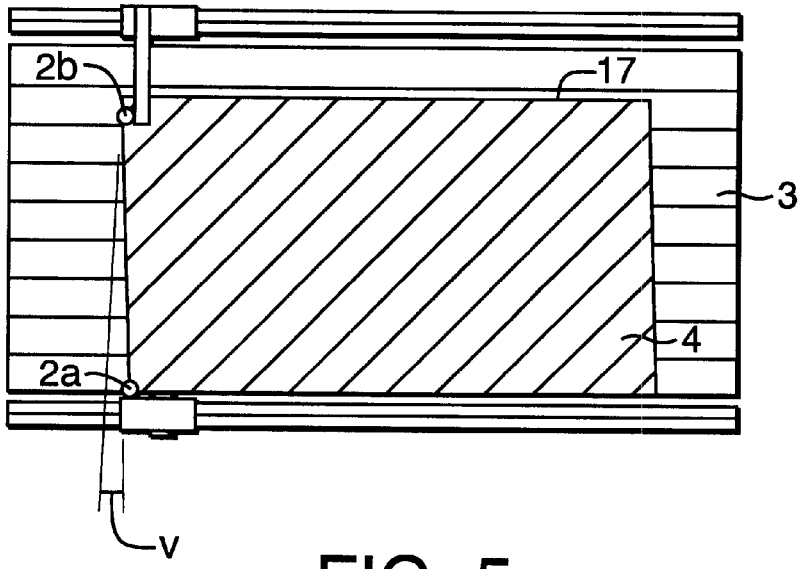
FIG. 5 a fourth phase of a turning operation in plane view.

In the second turning phase the gripping elements 2*a* and 2*b* are then moved in synchronism, i.e. at the same feed rate, in the opposite direction by a feed value, which is at least greater than the length of the portion of fabric 4. The final state after completion of the second phase of the turning operation is shown in FIG. 5. It is evident that the portion of fabric 4 is once more laid out on the conveyor belt 3 in the correct position, i.e. with a side edge 17 extending parallel to the conveyor belt 3. Between the gripping elements 2*a* and 2*b* there is once more a feed difference v which, in terms of its amount, corresponds to the feed difference d but with the sign reversed.

What is claimed is:

1. A method of aligning a portion of textile fabric, the method comprising:

providing at least two independently controllable and movable gripping elements of a display device are brought alongside one another into contact with and fastened to a front edge of the portion of fabric;

moving the gripping elements substantially parallel to a display surface of the display device until the portion of fabric is laid out with one side flat on the display surface;

adjusting a feed rate of the gripping elements so that alignment of the portion of fabric relative to the display surface is variable by means of a feed difference between the gripping elements.

2. A method as claimed in claim 1, wherein two gripping elements are fixed in corners of the portion of fabric.

3. A method as claimed in claim 1, further comprising:

measuring alignment of a side edge of the portion of fabric;

moving the independently movable gripping elements at different feed rates until substantial conformity of the alignment with a desired setpoint alignment is established.

4. A method as claimed in claim 1, wherein the alignment of the portion of fabric is controlled as a controlled variable in a control loop; a control element may vary the feed rates of the gripping elements in dependence upon a system deviation.

5. A method as claimed in claim 1, further comprising:

turning the portion of fabric after the portion of fabric has been laid out with a first side flat on the display surface, said turning including stopping the gripping elements and then moving the gripping elements substantially parallel to the display surface in an opposite direction until the portion of fabric has been substantially completely turned and is laid out with a second side on the display surface.

6. A method as claimed in claim 5, wherein after the portion of fabric has been laid out with a first side situated underneath, the feed difference between the gripping elements is acquired and stored, wherein a first of the gripping elements with the lowest feed value, for turning the portion of fabric, is moved in the opposite direction by a feed value which is at least greater than a length of the portion of fabric, and wherein a second of the gripping elements with the greatest feed value, for turning the portion of fabric, is moved in the opposite direction by a feed value which arises from the sum of the feed value of the first gripping element and twice the stored feed difference.

7. A method as claimed in claim 6, wherein for turning the portion of fabric, the second gripping element is initially moved in the opposite direction by a feed value which is twice the stored feed difference, while at the same time the first gripping element is stationary, and then both gripping elements are moved synchronously in the opposite direction by a feed value which is at least greater than the length of the portion of fabric.

8. A method in accordance with claim 1, further comprising:

acquiring a feed difference distance between said two gripping elements;

reversing a direction of a lead one of said gripping elements;

moving said lead one of said gripping elements in a reverse direction for twice said feed difference distance;

reversing and moving a trailing one of said gripping elements in said reverse direction after said moving of said lead one of said gripping elements.

9. An apparatus for laying out a portion of textile fabric, the apparatus comprising at least two movable gripping elements which are movable alongside one another into contact with and fastenable to a front edge of the portion of fabric, a display surface on which the portion of fabric may be laid out, said display surface having an alignment setpoint, and a control unit for controlling the gripping elements, the control unit moves the gripping elements independently of one another and varies a feed rate of the individual gripping elements while the portion of fabric is being laid out to align the fabric with the alignment setpoint.

10. An apparatus as claimed in claim 9, wherein the apparatus comprises at least one position sensor by means of which alignment of the portion of fabric is measured.

11. An apparatus as claimed in claim 9 or 10, wherein the apparatus comprises at least one control loop, by means of which the alignment of the portion of fabric as a controlled variable is controllable by varying the feed rate of the gripping elements.

12. An apparatus in accordance with claim 10, wherein said display surface has an alignment setpoint;

said position sensor measures an offset distance from another edge of the fabric to said alignment setpoint;

said control unit adjusts a rate of moving of said gripping elements to minimize said offset distance.

13. An apparatus as claimed in claim 9, wherein a feed difference between the gripping elements is acquired and stored in the control unit.

14. An apparatus as claimed in claim 9, wherein the two gripping elements are fixable in corners of the portion of fabric.

15. An apparatus in accordance with claim 9, wherein:

said control unit acquires a feed difference distance between said two gripping elements;

said control unit reverses a direction of a lead one of said gripping elements;

said control unit moves said lead one of said gripping elements in a reverse direction for twice said feed difference distance;

said control unit reverses and moves a trailing one of said gripping elements in said reverse direction after said moving of said lead one of said gripping elements.

16. A method for aligning a fabric, the method comprising the steps of:

providing display surface with an alignment setpoint;

providing first and second gripping elements independently movable across said display surface;

connecting a first edge of the fabric to said gripping elements;

moving said gripping elements with the fabric across said display surface;

measuring an offset distance from a second edge of the fabric to said alignment setpoint;

adjusting a rate of said moving of said gripping elements to minimize said offset distance.

17. A method in accordance with claim 16, further comprising:

acquiring a feed difference distance between said first and second gripping elements;

reversing a direction of a lead one of said gripping elements;

moving said lead one of said gripping elements in a reverse direction for twice said feed difference distance;

reversing and moving a trailing one of said gripping elements in said reverse direction after said moving of said lead one of said gripping elements.

18. A method in accordance with claim 17, wherein:

moving both said gripping elements at a substantially similar rate in said reverse direction after said reversing and moving of said trailing one of said gripping elements.

19. A method in accordance with claim 16, wherein:

moving said gripping elements with the fabric to a turnover position on said display surface;

performing said acquiring and said reversing at said turnover position.

* * * * *